US008932037B2

(12) United States Patent
Zinke

(10) Patent No.: US 8,932,037 B2
(45) Date of Patent: Jan. 13, 2015

(54) PUMP UNIT OF A VANE PUMP WITH MOVABLE SLEEVE AND SPRING ELEMENT

(75) Inventor: Boris Zinke, Kelkheim (DE)

(73) Assignee: Magna Powertrain Bad Homburg GmbH, Bad Homburg v.d.H. (DE)

( * ) Notice: Subject to any disclaimer, the term of this patent is extended or adjusted under 35 U.S.C. 154(b) by 1000 days.

(21) Appl. No.: 13/058,514

(22) PCT Filed: Jul. 20, 2009

(86) PCT No.: PCT/DE2009/001012

§ 371 (c)(1),
(2), (4) Date: May 4, 2011

(87) PCT Pub. No.: WO2010/017795

PCT Pub. Date: Feb. 18, 2010

(65) Prior Publication Data

US 2011/0211984 A1 Sep. 1, 2011

(30) Foreign Application Priority Data

Aug. 12, 2008 (DE) ..... 10 2008 038 718

(51) Int. Cl.

| | |
|---|---|
| ***F01C 19/08*** | (2006.01) |
| ***F04C 15/00*** | (2006.01) |
| *F04C 2/344* | (2006.01) |
| *F04C 14/06* | (2006.01) |
| *F04C 14/28* | (2006.01) |

(52) U.S. Cl.

CPC ..... *F04C 15/0026* (2013.01); *F04C 15/0038* (2013.01); *F04C 2/344* (2013.01); *F04C 14/06* (2013.01); *F04C 14/28* (2013.01); *F04C 2230/60* (2013.01); *F04C 2240/30* (2013.01)

USPC ..... 418/135; 418/131; 418/134

(58) Field of Classification Search

CPC ... F04C 15/0026; F04C 15/0038; F01C 19/08
USPC ..... 418/131, 134, 135
See application file for complete search history.

(56) References Cited

U.S. PATENT DOCUMENTS

| | | | | |
|---|---|---|---|---|
| 2,558,837 | A * | 7/1951 | Frei | 418/135 |
| 2,680,031 | A * | 6/1954 | Barr | 277/397 |
| 3,104,530 | A * | 9/1963 | Teichert | 60/427 |
| RE26,856 | E * | 4/1970 | Whitmore | 418/13 |
| 3,560,118 | A * | 2/1971 | Palachik | 418/26 |
| 4,415,319 | A * | 11/1983 | Masuda et al. | 418/135 |
| 4,419,058 | A * | 12/1983 | Franklin, Jr. et al. | 418/135 |
| 4,424,014 | A * | 1/1984 | Anderson | 418/133 |
| 4,505,655 | A * | 3/1985 | Honaga et al. | 418/135 |
| 5,290,155 | A * | 3/1994 | Snow et al. | 418/131 |
| 5,582,489 | A * | 12/1996 | Marzio et al. | 403/354 |
| 6,234,775 | B1 * | 5/2001 | Agner et al. | 418/132 |
| 6,599,111 | B2 * | 7/2003 | Ohtaki et al. | 418/135 |
| 6,641,380 | B1 * | 11/2003 | Nied-Menninger et al. | 418/135 |
| 6,655,936 | B2 * | 12/2003 | Szeszulski et al. | 418/135 |

FOREIGN PATENT DOCUMENTS

| | | |
|---|---|---|
| EP | 0399387 | 11/1990 |
| JP | 8042464 | 2/1996 |

* cited by examiner

*Primary Examiner* — Mary A Davis
(74) *Attorney, Agent, or Firm* — Davidson, Davidson & Kappel, LLC

(57) ABSTRACT

A pump unit of a vane-type pump having no dedicated housing including a drive shaft, a rotor that interacts with the drive shaft and accommodates vanes, a contour ring surrounding the rotor, and a first and a second side plate which are disposed laterally of the contour ring.

15 Claims, 2 Drawing Sheets

PUMP UNIT OF A VANE PUMP WITH MOVABLE SLEEVE AND SPRING ELEMENT

The present invention relates to a pump unit of a vane-type pump having no dedicated housing.

BACKGROUND

Pump units of the type discussed here are generally known. They are used, for example, in transmission housings of a motor vehicle or in other housings where a hydraulic supply is required. Pump units of this kind have a drive shaft, a rotor that cooperates with the drive shaft and that accommodates vanes which slide along a contour ring during a rotation of the rotor, two adjacent vanes enclosing cells which, in response to a rotation of the vanes, increase or decrease in volume, depending on the contour section, and, in the process, suction oil and discharge it again. In addition, a first and a second side plate are provided that are configured to the side of the contour ring. The known transmission pump units have the disadvantage that they tend to come apart during shipping, making it necessary to transport them in a housing or to undertake other measures for securing the same. Another disadvantage of the known pump units having no dedicated housing, is the relatively complex assembly that they require in a transmission housing, for example.

SUMMARY OF THE INVENTION

It is, therefore, an object of the present invention is to provide a pump unit that will make it possible to avoid any destruction to the pump unit when transporting the same and, moreover, that will permit an especially simple installation of the pump unit in a housing.

The present invention provides a pump unit having no dedicated housing, comprising a drive shaft; a rotor that cooperates with the drive shaft for accommodating vanes; a contour ring surrounding the rotor; a first and a second side plate, which are configured to the side of the contour ring. It is distinguished in that a sleeve is provided which is movably supported on the drive shaft and is located downstream of the second side plate in the axial direction of the pump unit. It also has the feature whereby a securing element is provided for axially securing the sleeve on the drive shaft, thereby preventing the pump unit from coming apart during shipment. Moreover, the pump unit features a spring element which preloads the second side plate against the transmission housing, the spring element being a fixed component of the pump unit. In this manner, the individual elements of the pump unit are held securely together even during transporting of the same and, moreover, it is ensured that the second side plate engages securely on the contour ring when the pump is assembled in a housing, thereby avoiding problems associated with starting up the pump unit. Another advantage of the pump unit provided here is the particularly flexible use thereof in that the spring element makes it possible to compensate for tolerances in the event of dimensional variations.

One exemplary embodiment of the present invention is especially preferred that has the feature whereby the securing element is a locking ring that cooperates with the drive shaft. This provides for a reliable axial securing of the sleeve on the drive shaft, so that the individual components of the pump unit are not able to slip from the drive shaft during shipment. This eliminates the need for a pump housing for transporting the pump unit. It is thus possible to transport the pump unit as a compact unit without employing additional measures for securing the same.

Another preferred exemplary embodiment of the present invention has the feature whereby the pump unit has a through drive. In this manner, a sampling of the rotational speed may be realized, for example, when two couplings are to be regulated.

One exemplary embodiment of the present invention is also preferred which has the feature whereby the spring element is designed as a disk spring that is braced on one side against the second side plate and, on the other side, against the sleeve. The sleeve is then preferably supported, in turn, via a collar on the transmission housing, so that the spring element preloads the second side plate against the housing, in particular, against the transmission housing. This exemplary embodiment is particularly advantageous when the sleeve is movably supported in the axial direction on an extension of the second side plate. In this manner, when the pump is installed, a secure engagement of the pump components may be ensured.

Another preferred exemplary embodiment of the present invention provides that this spring element, in particular the disk spring, is provided with orifices, so that flow-through channels, which have a lowest possible flow resistance, are formed which lead from the pressure outlets of the pump unit to a pressure chamber.

Another preferred exemplary embodiment of the present invention provides that the sleeve and the second side plate are formed in one piece. In this exemplary embodiment as well, a securing element is preferably used to axially secure the sleeve. The spring element is designed as a compression spring, preferably as a coil spring, in particular as a frustoconical coil spring that is braced on one side against the second side plate and, on the other side, against a supporting device which is movably supported on the sleeve. The supporting device may be designed in any given manner, for example as a disk. It is also conceivable for a groove to be introduced into the sleeve and for one end of the coil spring to be displaceably positioned within the groove. In this specific embodiment, it is also important that the side plate be preloaded against the housing, so that, when the pump unit is assembled in a housing, a secure engagement of the individual components relative to one another is ensured, thereby avoiding the difficulties associated with starting up the pump unit.

Another preferred exemplary embodiment of the present invention has the feature whereby a first axial bearing is realized by a shaft collar that cooperates with the rotor, and a second axial bearing is realized by a retaining ring that cooperates with the rotor. In this manner, the rotor itself is used as an axial bearing in the case of a pulling or a pushing of the drive shaft.

One exemplary embodiment of the present invention is also preferred that has the feature whereby a shaft collar is provided for axially securing the first pressure plate. In this manner, all elements of the pump unit are securely supported on the drive shaft and are not able to fall off of the same. Thus, the pump unit may be safely transported without the need for any additional measures for securing the same.

Finally, an exemplary embodiment of the present invention is preferred that has the feature whereby O-rings are provided for radially sealing the pump unit from the housing, the first side plate, the second side plate and the sleeve preferably cooperating with at least one O-ring. Radial shaft sealing rings are also provided, in particular for sealing pump components that execute a rotation relative to each other, a radial shaft sealing ring preferably being provided between the drive shaft and the first side plate, and a second radial shaft sealing ring between the drive shaft and the sleeve.

BRIEF DESCRIPTION OF THE DRAWINGS

The present invention is clarified in greater detail in the following, with reference to the drawing, whose figures show.

DETAILED DESCRIPTION

Figure 1:
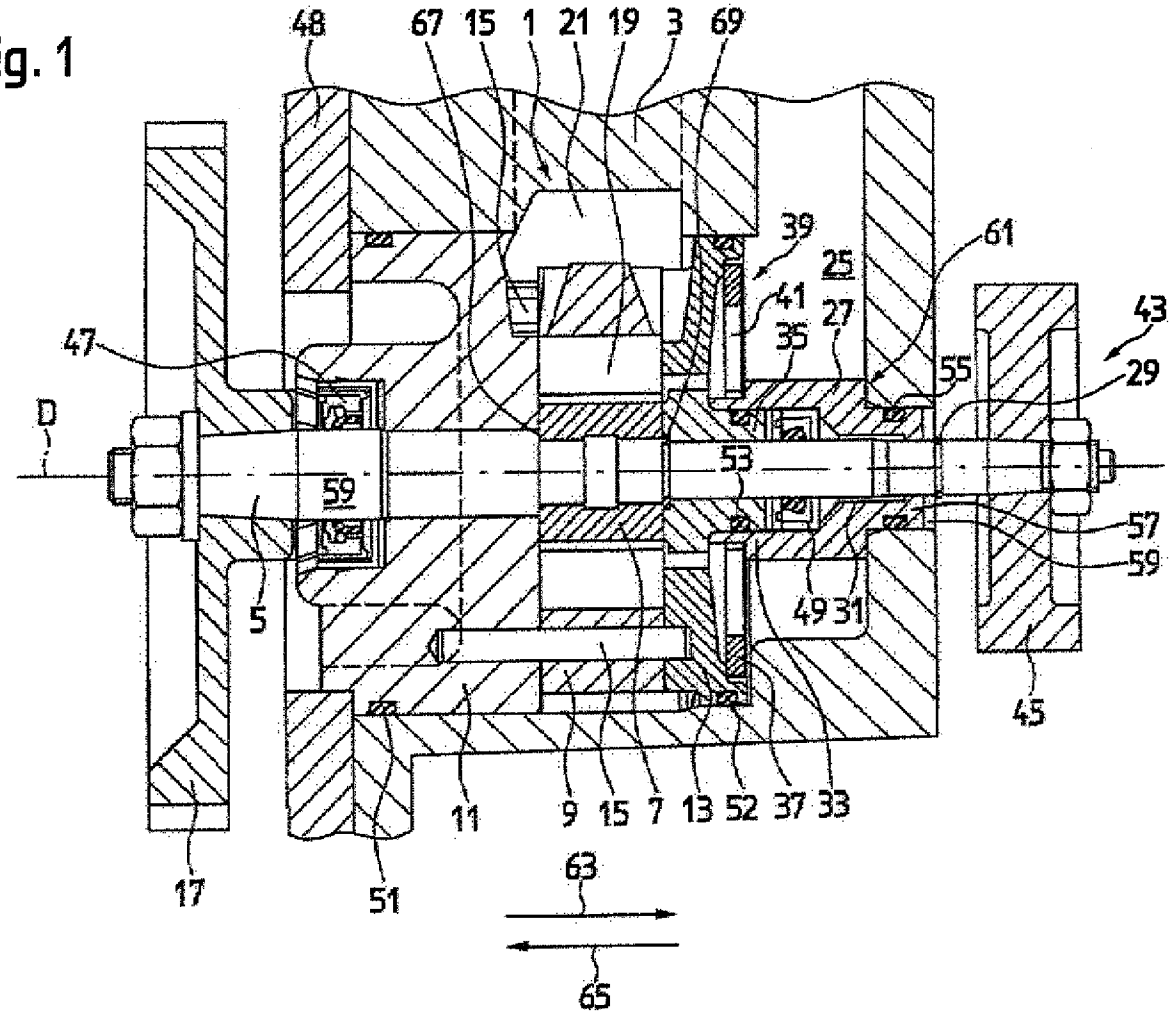
FIG. 1 a schematized sectional view of a first exemplary embodiment of the pump unit.

FIG. 1 shows a schematized sectional view of a pump unit 1 of a vane-type pump which is configured in a housing, here exemplarily in a transmission housing 3. It encompasses a drive shaft 5, which is connected in a torsionally fixed manner, for example via a toothing or the like, to a rotor 7. Moreover, a contour ring 9 is provided that is configured around rotor 7 and is surrounded by a first side plate 11 and a second side plate 13 through which drive shaft 5 completely extends. The exact radial position of side plates 11 and 13, as well as of contour ring 9 in relation to one another is ensured by pins 15 which extend completely through side plates 11 and 13 and contour ring 9.

Drive shaft 5 is driven by a driving gear, here purely exemplarily by a toothed wheel 17. The use of a sprocket or of a belt drive or the like is also conceivable, however.

Rotor 7 serves to accommodate a plurality of vanes 19, which, in response to a rotation of rotor 7 about axis of rotation D of drive shaft 5, slide along the inner side of contour ring 9. Clearly discernible in FIG. 1 is a suction region 21, from where vane-type pump draws in hydraulic oil and delivers it via pressure outlets provided in second pressure plate 13 to a pressure chamber 25. From there, the hydraulic oil reaches a consumer. The further operating principle of a vane-type pump is adequately described in the related art, so that there is no need to discuss it here in greater detail.

Pump unit 1 has a sleeve 27 which is configured coaxially to drive shaft 5 and axially displaceably thereon. Moreover, it is situated downstream of second side plate 13 in the axial direction of pump unit 1, thus in the direction of axis of rotation D, thus on the side of second side plate 13 opposing the drive side. To axially secure sleeve 27 on drive shaft 5, a securing element 29 is provided, which is preferably designed as a locking ring and which prevents sleeve 27 from sliding off of drive shaft 5 during shipment of pump unit 1.

FIG. 1 makes it clear that sleeve 27, having a first section 31 in transmission housing 3 and a second section 33, is supported axially displaceably on an extension 35 of second side plate 13. An O-ring seal 53 for radially sealing pump unit 1 is provided between extension 35 of second side plate 13 and second section 33 of sleeve 27.

In addition, pump unit 1 has a spring element 39, which is configured coaxially to drive shaft 5 and which, on the one hand, in a radially outwardly disposed region with respect to axis of rotation D, is braced against second side plate 13 and, on the other hand, in a radially inwardly disposed region, is braced against sleeve 27. In this case, spring element 39 is designed as a disk spring and is provided with orifices 41 to ensure a fluid communication between pressure outlets 23 and pressure chamber 25. Orifices 41 are preferably formed in a way that provides a lowest possible flow resistance of spring element 39. Conceivable, however, is the design of spring element 39 as a frustoconical coil spring. Important in this case is the design of spring element 39 as a compression spring which is able to preload second side plate 13 against the housing.

At its end facing away from toothed wheel 17, shaft 5 has a through drive 43, which is provided here purely exemplarily with an inductor 45, in order to realize a rotational speed sampling. To this end, inductor 45 preferably encompasses permanent magnets which cooperate with a sensor for recording the rotational speed of drive shaft 5.

In the exemplary embodiment in accordance with FIG. 1, pump unit 1 is axially secured in transmission housing 3 purely exemplarily by a housing component 48. However, a locking washer or the like may conceivably be used to secure pump unit 1 in transmission housing 3 in a different manner, for example.

To radially seal pump unit 1 from transmission housing 3, a first radial shaft sealing ring 47 configured between first side plate 11 and drive shaft 5, and a second radial shaft sealing ring 49 configured between sleeve 27 and drive shaft 5 are provided. Since it is a question of components that execute a relative movement during operation of pump unit 1, the use of O-rings would be inadequate in this case. Moreover, an O-ring seal 51 is provided to provide radial sealing between first side plate 11 and transmission housing 3. An O-ring seal 52 also seals second side plate 13 from transmission housing 3 in the radial direction.

Another O-ring seal 53 is provided in the area between second section 33 of sleeve 27 and extension 35 of second side plate 13. Finally, for radial sealing action, an O-ring seal 55 is also configured between a section 57 of sleeve 27, which has a reduced diameter compared to remaining sleeve 27, and transmission housing 3.

To axially secure first side plate 11, drive shaft 5 is provided with a shaft collar 59, so that first side plate 11 is prevented from falling off of drive shaft 5.

Overall, therefore, it has been shown that pump unit 1 is designed as a compact unit, all of whose elements are securely supported, on the one hand, by shaft collar 59 and, on the other hand, by securing ring 29 on drive shaft 5, and that pump unit 1 is reliably prevented from coming apart during shipment.

During shipment of pump unit 1, respectively in the uninstalled state of pump unit 1, spring element 39 is in the more relieved state, so that sleeve 27 is axially displaced on drive shaft 5 and on extension 35 and is pressed against securing ring 29.

When transmission unit 1 is installed in transmission housing 3, section 57 of sleeve 27 that is reduced in diameter is introduced into an opening 59 provided in transmission housing 3, until sleeve 27 engages on a collar 61 on transmission housing 3. Pump unit 1 may then be displaced further into transmission housing 3 until its optimal position is reached. In this installed state of pump unit 1, spring element 39 is compressed, so that second side plate 13 is preloaded against sleeve 27 and thus against transmission housing 3, and is pressed against contour ring 9, which, in turn, is braced against first side plate 11, which, for its part, is axially secured by housing part 48. Thus, already in the unpressurized state of pump unit 1, the spring force of spring element 39 ensures a secure engagement and sealing of the two side plates on contour ring 9, and thus a pressure build-up and a frictionless start-up of pump unit 1. Thus, the pump components are held securely together even during the transporting of pump unit 1.

FIG. 1 clearly shows that, in the installed state of pump unit 1, sleeve 27 no longer engages on securing ring 29; rather, due to the engagement of collar 61 on transmission housing 3, it is configured at a distance of a few millimeters therefrom. Thus, in the uninstalled state of pump unit 1, a certain amount of play is present between the individual pump elements, so that spring element 39 does not exert its full action until pump unit 1 is installed. Moreover, a particular advantage of pump unit 1 provided here is that spring element 39 constitutes a fixed component of pump unit 1. Moreover, it is particularly advantageous that spring element 39 compensates for any existing manufacturing tolerances that may arise in the case of the bore provided in transmission housing 3 for accommodating pump unit 1.

The embodiment of pump unit 1 provided here is particularly advantageous when a through drive 43 is provided, for example, to realize a rotational speed sampling.

The present pump unit 1 also encompasses two axial bearings for the case that the shaft is pushed in the direction of arrow 63 or drive shaft 5 is pulled in the direction of arrow 65. Operating states of this kind should, in fact, be avoided during operation of pump unit 1. However, it is necessary to provide axial bearings for the case that an operating state of this kind occurs.

For this purpose, in the case of pump unit 1 for realizing a first axial bearing, a collar 67 is provided on drive shaft 5 that is configured to the left next to rotor 7, and that, in response to a displacement of drive shaft 5 in the direction of arrow 63, is urged into engagement with rotor 7 and entrains the same, so that rotor 7 is displaced in the direction of second side plate 13. To realize a second axial bearing, a securing ring 69 that is configured to the right next to rotor 7 is provided on drive shaft 5, and, in response to a movement of drive shaft 5 in the direction of arrow 65, entrains rotor 7 and displaces the same in the direction of first side plate 11. It is evident that rotor 7 is used here as an axial bearing, which, in response to an axial loading of the shaft, cooperates with first side plate 11, respectively with second side plate 13.

Figure 2:
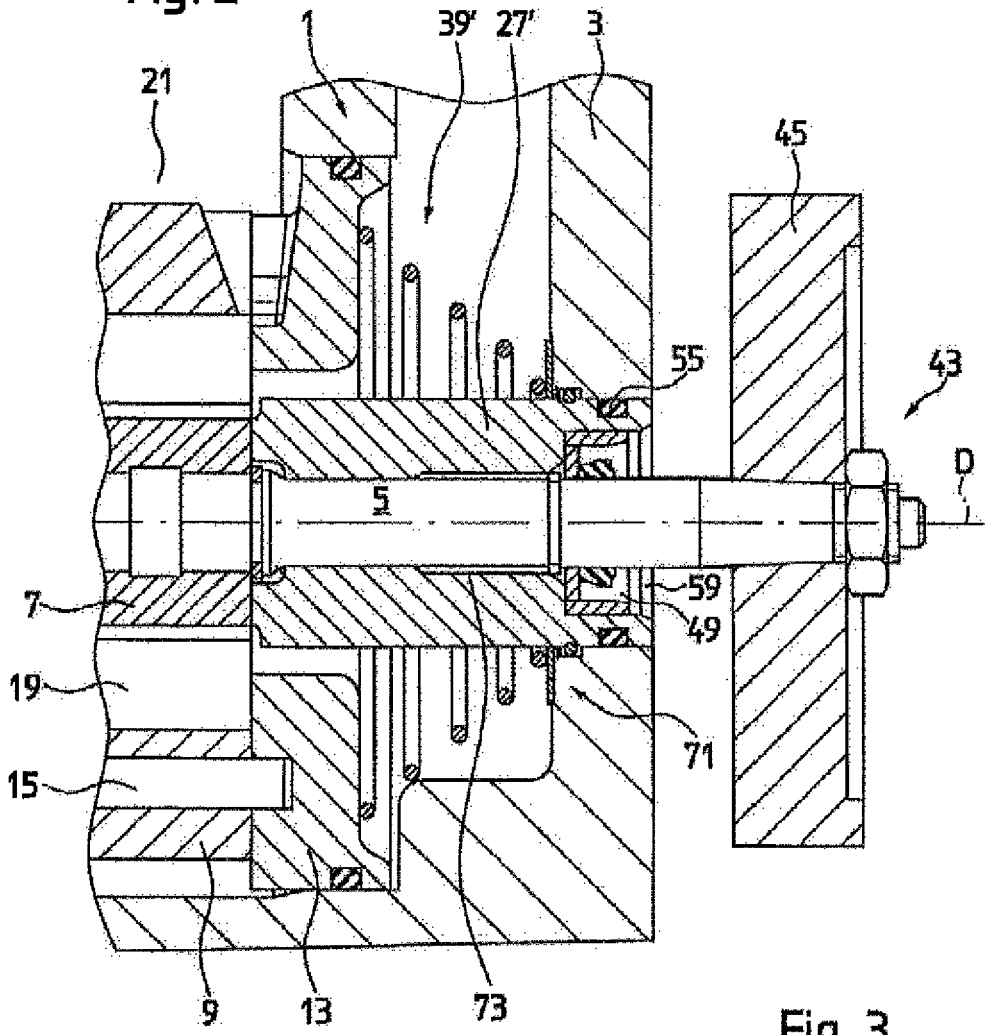
FIG. 2 a schematized sectional view of a second exemplary embodiment of the pump unit.

FIG. 2 shows a schematized sectional view of a second exemplary embodiment of a pump unit 1. Like parts are denoted by the same reference numerals, so that, in this respect, reference is made to the description of FIG. 1.

In contrast to FIG. 1, merely one section of pump unit 1 is shown in FIG. 2. In the exemplary embodiment in accordance with FIG. 2, a sleeve 27' is formed in one piece with second side plate 13. A frustoconical coil spring that is configured coaxially to drive shaft 5 is used as spring element 39' and is braced at one end against side plate 13 in a radially outwardly disposed region with respect to axis of rotation D and is braced by its other end in a radially inwardly disposed region against a supporting device 71.

Figure 3:
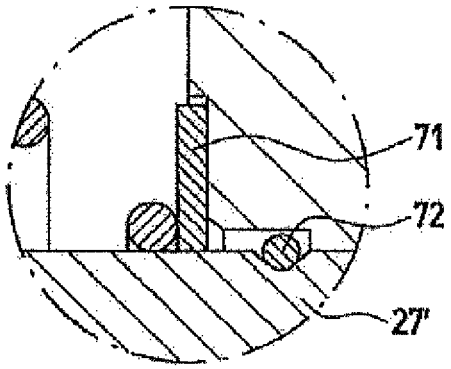
FIG. 3 an enlarged representation of a detail of the pump unit according to FIG. 2.

For the sake of illustration, FIG. 3 shows an enlarged representation of the corresponding region of pump unit 1. It is clear that supporting device 71 is movably supported on sleeve 27'. It must be designed in such a way that it is not able to fall off of sleeve 27'. To this end, it may cooperate, for example, with a suitable securing element 72 that is introduced into sleeve 27' and that is designed here exemplarily as a retaining ring.

As illustrated in FIG. 2, supporting device 71 may, for example, be designed as a disk that is used as an abutment for spring element 39'.

To axially secure sleeve 27' on drive shaft 5, a retaining ring corresponding to the exemplary embodiment in accordance with FIG. 1 may be provided which prevents sleeve 27' from falling out. However, a retaining ring 73 may also be provided, which is configured between drive shaft 5 and sleeve 27' and permits an axial displacement of sleeve 27' via an elongated, annular-groove shaped region.

In this exemplary embodiment as well, an O-ring seal 55 seals sleeve 27' from transmission housing 3 in the radial direction. To ensure a sealing action between sleeve 27' and drive shaft 5, the first exemplary embodiment provides a radial shaft sealing ring 49 in accordance with FIG. 1.

It is evident that, even in the case of the second exemplary embodiment, a compact pump 1 is devised whereby the danger of a breakup during shipment is avoided by a securing element, in particular, by retaining ring 73. Moreover, here as well, spring element 39 fulfills the advantageous function of preloading second side plate 13 against transmission housing 3, so that a secure engagement of the individual pump elements against one another is provided, and a start-up of the pump in the unpressurized state is ensured, and, at the same time, manufacturing tolerances are compensated.

In the installed state of pump unit 1 in accordance with FIG. 2, sleeve 27' is again configured in opening 59 of transmission housing 3. However, in contrast to the exemplary embodiment in accordance with FIG. 1, sleeve 27' is not supported via a collar on transmission housing 3; rather, spring element 39' is braced against supporting device 71 and thus directly against transmission housing 3. In this manner, spring element 39' exerts a force on second side plate 13, so that side plates 11 and 13 rest against contour ring 9. In this context, a shifting of side plate 13 and, consequently, a shifting of sleeve 27' in opening 59 may occur, which is why supporting device 71' must be movably supported on sleeve 27'. Depending on how far sleeve 27' projects into opening 59, spring element 39' is compressed to a greater or lesser degree. In the disassembled state of pump unit 1, thus, in particular, during shipment, spring element 39' shifts supporting device 71 as far to the right as possible, up to a limit stop on sleeve 27', so that spring element 39' is again in a more relieved state.

Due to the movable positioning of supporting element 71 on sleeve 27', it is always pressed by spring element 39' against transmission housing 3.

Altogether, it has been shown that a pump unit is devised by the present invention that has the feature whereby a sleeve 27, respectively 27' is provided, which is movably supported on the drive shaft and is situated downstream of second side plate 13 in the axial direction of pump unit 1, and that a securing element 29, respectively 73 is provided for axially securing sleeve 27, 27' on drive shaft 5. In this manner, pump unit 1 may be transported without the need for any additional measures for securing the same, since a falling apart of pump unit 1 is avoided. Spring element 39, respectively 39' is a fixed component of pump unit 1 and preloads second side plate 13 against transmission housing 3. In this manner, a separation of the pump elements is avoided in the unpressurized state of pump unit 1, and the sealing action allows pump unit 1 to readily build up pressure and start up. Moreover, manufacturing-induced tolerances are compensated by spring element 39, 39', thereby permitting an optimal adaptation of pump unit 1 and allowing for an especially flexible use thereof.

LIST OF REFERENCE NUMERALS

1 pump unit
3 transmission housing
5 drive shaft
7 rotor
9 contour ring
11 first side plate
13 second side plate
15 pins
17 toothed wheel
19 vane

21 suction region
23 pressure outlet
25 pressurized chamber
27 sleeve
27' sleeve
29 retaining ring
31 first section
33 second section
35 extension
39 spring element
39' spring element
41 orifices
43 through drive
45 inductor
47 first radial shaft sealing ring
48 housing component
49 second radial shaft sealing ring
51 O-ring seal
53 O-ring seal
55 O-ring seal
57 section
59 opening
61 collar
63 arrow (pulling)
65 arrow (pushing)
67 collar
69 retaining ring
71 supporting device
72 retaining ring
73 retaining ring

What is claimed is:

1. A pump unit of a vane pump having no dedicated housing, comprising:

a drive shaft;

a rotor cooperating with the drive shaft for accommodating vanes;

a contour ring surrounding the rotor;

a first and a second side plate, the first and second side plate being configured to a side of the contour ring;

a sleeve being movably supported on the drive shaft, the sleeve being situated downstream of the second side plate in an axial direction of the pump unit;

a securing element for axially securing the sleeve on the drive shaft in an uninstalled state of the pump unit, the pump unit not being installed in a transmission housing in the uninstalled state;

a spring element, the spring element preloading the second side plate against a first portion of the transmission housing in an installed state of the pump unit, the pump unit being installed in the transmission housing in the installed state, the spring element being a fixed component of the pump unit; and a supporting device on a radial outer surface of the sleeve, the supporting device axially abutting a second portion of the transmission housing axially opposite the first portion of the transmission housing in the installed state such that the rotor is axially between the first portion of the transmission housing and the second portion of the transmission housing.

2. The pump unit as recited in claim 1 wherein the securing element is a locking ring that cooperates with the drive shaft.

3. The pump unit as recited in claim 1 wherein the pump unit has a through drive.

4. The pump unit as recited in claim 1 wherein the sleeve and the second side plate are one piece.

5. The pump unit as recited in claim 4 wherein the spring element is a frustoconical coil spring braced on one side against the second side plate and on the other side against the supporting device movably supported on the sleeve.

6. The pump unit as recited in claim 1 wherein a first axial bearing includes a shaft collar cooperating with the rotor, and a second axial bearing includes a retaining ring cooperating with the rotor.

7. The pump unit as recited in one claim 1 wherein the first side plate is axially secured by a shaft collar.

8. The pump unit as recited in claim 1 further comprising O-rings to radially seal the pump unit, the O-rings cooperating with the first side plate, the second side plate and the sleeve.

9. The pump unit as recited in claim 1 further comprising a first radial shaft sealing ring and a second radial shaft sealing to radially seal the pump unit, the first radial shaft sealing ring being between the drive shaft and the first side plate, and the second radial shaft sealing ring being between the drive shaft and the sleeve.

10. The pump unit as recited in claim 1 wherein the spring element is compressed more in the installed state than in the uninstalled state.

11. The pump unit as recited in claim 1 wherein the sleeve engages the securing element in the uninstalled state and the sleeve does not engage the securing element in the installed state.

12. The pump unit as recited in claim 1 wherein the spring element forces the sleeve axially away from the rotor.

13. The pump unit as recited in claim 1 wherein the second side plate includes a first axial side facing the rotor and a second axial side facing the away from the rotor, the spring element contacting the second axial side of the second side plate.

14. The pump unit as recited in claim 1 wherein the spring element is compressed between the second side plate and the supporting device in the installed state.

15. The pump unit as recited in claim 1 wherein the sleeve axially abuts a second portion of the transmission housing axially opposite the first portion of the transmission housing in the installed state such that the rotor is axially between the first portion of the transmission housing and the second portion of the transmission housing, the spring element being compressed between the second side plate and the sleeve in the installed state.

* * * * *